US012188663B2

(12) United States Patent
Seok et al.

(10) Patent No.: US 12,188,663 B2
(45) Date of Patent: Jan. 7, 2025

(54) COOKING DEVICE

(71) Applicant: LG ELECTRONICS INC., Seoul (KR)

(72) Inventors: Junho Seok, Seoul (KR); Daebong Yang, Seoul (KR); Jeahyuk Wie, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/227,843

(22) Filed: Jul. 28, 2023

(65) Prior Publication Data

US 2023/0375189 A1 Nov. 23, 2023

Related U.S. Application Data

(62) Division of application No. 17/324,955, filed on May 19, 2021, now Pat. No. 11,754,295, which is a (Continued)

(30) Foreign Application Priority Data

Apr. 30, 2015 (KR) ..... 10-2015-0061813

(51) Int. Cl.
*F24C 3/00* (2006.01)
*F24C 15/32* (2006.01)
*F24C 3/02* (2021.01)

(52) U.S. Cl.
CPC ..... *F24C 15/322* (2013.01); *F24C 3/008* (2013.01); *F24C 3/027* (2013.01)

(58) Field of Classification Search
CPC ..... F24C 15/322; F24C 3/008; F24C 3/027
See application file for complete search history.

(56) References Cited

U.S. PATENT DOCUMENTS 4,813,398 A 3/1989 Savage
9,534,791 B2 * 1/2017 Wie ..... F24C 5/12
(Continued)

FOREIGN PATENT DOCUMENTS

JP 2002-170661 A 6/2002
JP 2004-317111 A 11/2004
KR 10-2014-0067749 A 6/2014

OTHER PUBLICATIONS

U.S. Appl. No. 17/324,955, filed May 19, 2021.
(Continued)

*Primary Examiner* — Alfred Basichas
(74) *Attorney, Agent, or Firm* — Bryan Cave Leighton Paisner LLP

(57) ABSTRACT

A cooking device includes a frame to form a cooking chamber; a burner disposed in the cooking chamber and to generate a flame for supplying heat to the cooking chamber; a burner cover in which the burner is installed and having a plate with an outlet opening through which an air passes; a fan to flow an air of the cooking chamber; and a stabilizer to reduce an influence of the air on a flame of the burner when the air of the cooking chamber passes through the outlet opening of the burner cover by the fan. The stabilizer includes: a body having an opening for air passage; a barrier extended from the body; and a fastening unit for fastening the body to the burner cover, and while the fastening unit is fastened to the burner cover, the body is spaced apart from the plate of the burner cover.

15 Claims, 23 Drawing Sheets

Related U.S. Application Data division of application No. 16/365,467, filed on Mar. 26, 2019, now Pat. No. 11,041,630, which is a division of application No. 15/140,222, filed on Apr. 27, 2016, now Pat. No. 10,295,196.

(56) References Cited

U.S. PATENT DOCUMENTS

| | | | | |
|---|---|---|---|---|
| 9,874,357 | B2 * | 1/2018 | Wie | F24C 3/087 |
| 9,939,159 | B2 * | 4/2018 | Wie | F24C 3/087 |
| 10,295,196 | B2 * | 5/2019 | Seok | F24C 15/322 |
| 10,451,288 | B2 * | 10/2019 | Lee | F24C 15/322 |
| 11,041,630 | B2 * | 6/2021 | Seok | F24C 15/322 |
| 11,754,295 | B2 * | 9/2023 | Seok | F24C 3/008 126/39 C |
| 2014/0144423 | A1 | 5/2014 | Wie | F24C 15/322 126/39 E |

OTHER PUBLICATIONS

U.S. Appl. No. 16/365,467, filed Mar. 26, 2019.
U.S. Appl. No. 15/140,222, filed Apr. 27, 2016.
U.S. Appl. No. 15/140,222, filed Apr. 27, 2016, U.S. Pat. No. 10,295,196.

* cited by examiner

COOKING DEVICE

CROSS-REFERENCE TO RELATED APPLICATIONS

This application is a Divisional Application of U.S. patent application Ser. No. 17/324,955, filed May 19, 2019, which is a Divisional Application of U.S. patent application Ser. No. 16/365,467, filed Mar. 26, 2019, now patented, which is a Divisional of U.S. patent application Ser. No. 15/140,222, filed Apr. 27, 2016, now patented, which claims the benefit of KR Patent Application No. 10-2015-0061813, filed Apr. 30, 2015, the contents of which are all hereby incorporated by reference herein in their entirety.

BACKGROUND

1. Field

A cooking device is disclosed herein.

2. Background

A cooking device is a device for cooking food using heat of a heating source. As an example of the cooking device, an oven range includes an oven chamber in which the food is cooked, and a burner which cooks the food in the oven chamber by burning a gas.

In Korean Patent Publication No. 10-2010-0013997 (published on Feb. 10, 2010) as a prior art document, there is disclosed an oven range.

In the oven range, a burner chamber is provided under a bottom surface thereof which forms an oven chamber, and a lower burner which convectively heats food in the oven chamber is installed in the burner chamber.

The oven range in the prior art document has the following problems.

First, as described above, to provide air heated by the lower burner from the burner chamber into the oven chamber, the oven chamber and the burner chamber are in communication with each other. However, since the burner chamber is provided under the oven chamber, a part of the bottom surface of the oven chamber should be open.

When a part of the bottom surface of the oven chamber is open, food leftovers or the like may be introduced into the burner chamber through an open portion of the oven chamber in communication with the burner chamber when the food is cooked in the oven chamber or the food is put into or taken out of the oven chamber. Therefore, a product may be contaminated by the food leftovers or the like.

Also, since a part of the bottom surface of the oven chamber is open, it is not easy to clean the oven chamber due to an opening of the bottom surface.

Also, since the lower burner is installed under the oven chamber, a cavity capacity is reduced by a burner installation space.

SUMMARY

A cooking device is disclosed herein.

According to an aspect of the present invention, there is provided a cooking device including a frame configured to form a cooking chamber; a burner disposed in the cooking chamber and configured to generate a flame for supplying heat to the cooking chamber; a burner cover in which the burner is installed and having a plate with an outlet opening through which an air passes; a fan configured to flow an air of the cooking chamber; and a stabilizer configured to reduce an influence of the air on a flame of the burner when the air of the cooking chamber passes through the outlet opening of the burner cover by the fan, wherein the stabilizer includes: a body having an opening for air passage; a barrier extended from the body; and a fastening unit for fastening the body to the burner cover, and while the fastening unit is fastened to the burner cover, the body is spaced apart from the plate of the burner cover.

According to another aspect of the present invention, there is provided a cooking device including a frame configured to form a cooking chamber; a burner disposed in the cooking chamber, and configured to generate a flame for supplying heat to the cooking chamber; a burner cover forming a combustion chamber in which the burner is located, and having an outlet opening through which an air passes and a hook coupling hole; a fan for flowing an air of the cooking chamber; and a stabilizer fastened to the burner cover in the combustion chamber, wherein the stabilizer includes a body having an opening for air passage, a barrier extended from the body, a fastening unit for fastening the body to the burner cover, and a hook which is inserted in the hook coupling hole for fastening the body to the burner cover, and while the hook is aligned with the hook coupling hole, a fastening hole of the stabilizer and a fastening hole of the burner cover are non-aligned.

BRIEF DESCRIPTION OF THE DRAWINGS

Embodiments will be described in detail with reference to the following drawings in which like reference numerals refer to like elements, and wherein.

DETAILED DESCRIPTION OF THE EMBODIMENTS

Figure 1:
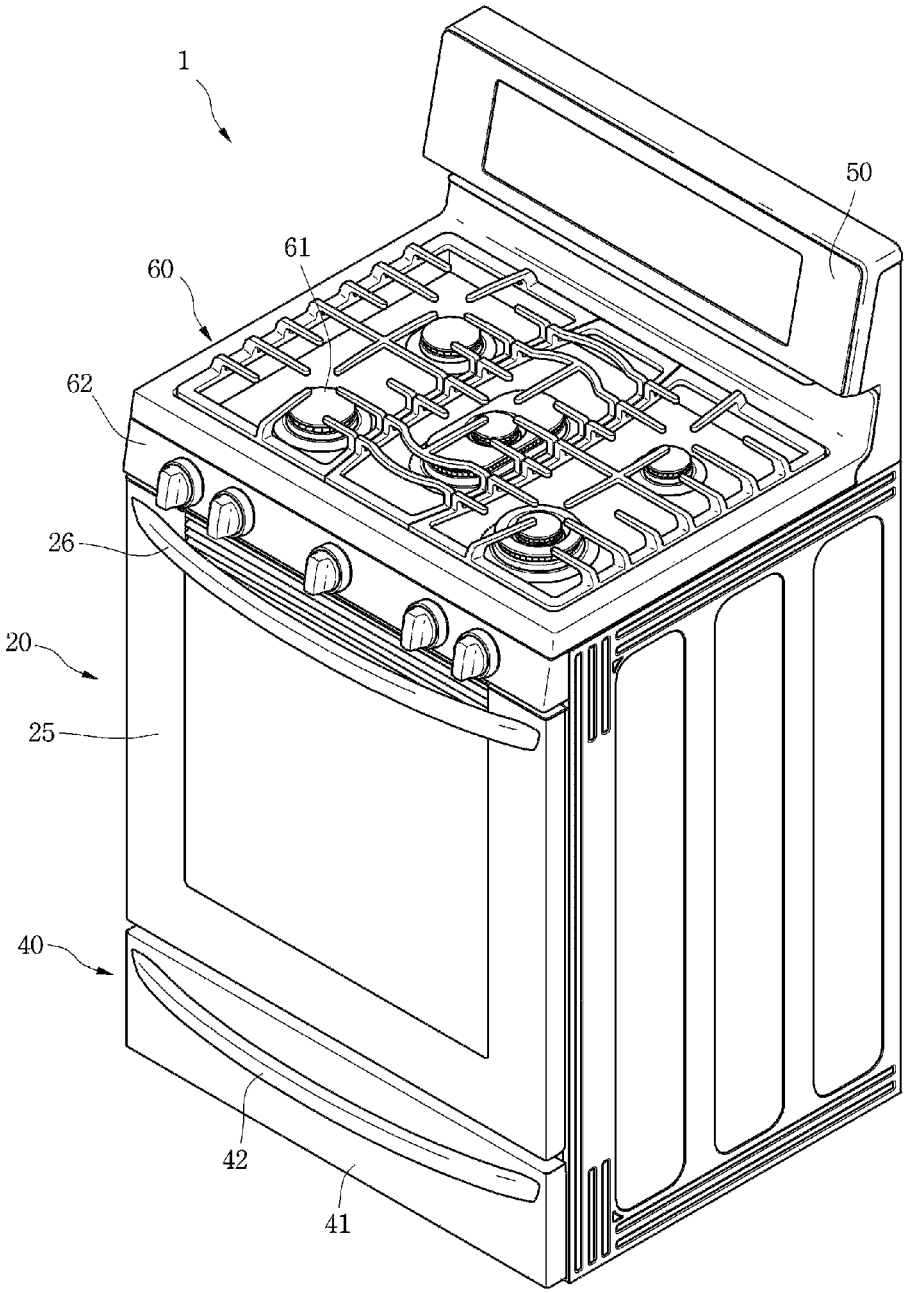
FIG. 1 is a perspective view of a cooking device according to one embodiment of the present invention.

Reference will now be made in detail to the embodiments of the present disclosure, examples of which are illustrated in the accompanying drawings.

Hereinafter, exemplary embodiments of the present disclosure will be described with reference to the accompanying drawings. Regarding the reference numerals assigned to the elements in the drawings, it should be noted that the same elements may be designated by the same reference numerals, wherever possible, even though they are shown in different drawings. Also, in the description of embodiments, detailed description of well-known related structures or functions may be omitted when it is deemed that such description may cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected," "coupled," and "joined" to the latter via another component.

Figure 2:
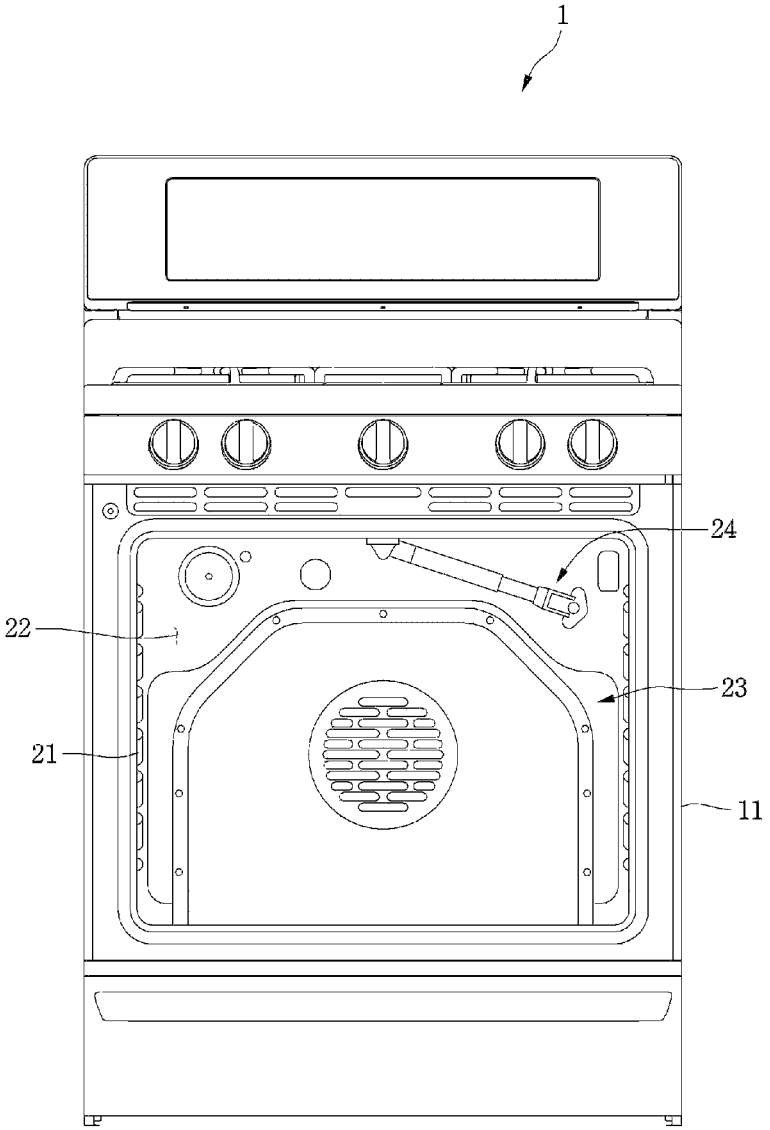
FIG. 2 is a front view illustrating a state in which a door is removed from the cooking device according to one embodiment of the present invention.

FIG. 1 is a perspective view of a cooking device according to an embodiment of the present invention, and FIG. 2 is a front view when a door is removed from the cooking device according to the embodiment of the present invention.

Referring to FIGS. 1 and 2, a cooking device 1 according to the first embodiment of the present invention may include an oven unit 20.

The cooking device 1 may further include a cook-top unit 60. The cooking device 1 may further include a drawer unit 40. The cooking device 1 may further include a control unit 50.

The cooking device 1 may further include an outer case 11. The outer case 11 may cover both side surfaces and rear surfaces of the oven unit 20 and the drawer unit 40.

However, the cook-top unit 60 and the drawer unit 40 may be omitted according to a type of the cooking device 1.

The cook-top unit 60, the oven unit 20, and the drawer unit 40 may be disposed at an upper portion, a center portion, and a lower portion of the cooking device 1, respectively. Further, the control unit 50 is disposed at a rear portion of an upper surface of the cooking device 1.

The cook-top unit 60 may include a plurality of cook-top burners 61. The cook-top burners 61 may heat a container in which food is put or may directly heat the food using a flame generated by burning a gas, and thus may cook the food. An operational unit 62 which operates the plurality of cook-top burners 61 may be disposed at a front end of the cook-top unit 60. Alternatively, the operational unit 62 may be disposed at an upper surface of the cook-top unit 60.

As another example, the cook-top unit 60 may include one or more electric heaters. However, the one or more electric heaters may not be exposed to the outside of the cook-top unit 60. Therefore, in the embodiment, a type of a heating source forming the cook-top unit 60 is not limited.

The oven unit 20 may include a frame 21 forming a cooking chamber 22 in which the cooking of food is performed.

For example, the frame 21 may be formed in a rectangular parallelepiped shape of which a front surface is open, but is not limited thereto.

The oven unit 20 may further include a burner assembly 23 for cooking the food accommodated in the cooking chamber 22. The oven unit 20 may further include an upper burner 24.

The burner assembly 23 and the upper burner 24 may simultaneously heat the food, or any one of the burner assembly 23 and the upper burner 24 may heat the food.

The upper burner 24 provides heat to the food from above the food in the frame 21, and the burner assembly 23 may be disposed at the rear of the food in the frame 21.

For example, the upper burner 24 may be installed at an upper wall of the frame 21, and the burner assembly 23 may be installed at a rear wall of the frame 21.

The oven unit 20 may further include a door 25 which opens and closes the cooking chamber 22. The door 25 may be rotatably connected to the cooking device 1. For example, the door 25 opens and closes the cooking chamber 22 in a pull-down method in which an upper end is vertically rotated about a lower end. In the embodiment, an operating method of the door 25 is not limited.

A door handle 26 gripped by a user' hand to rotate the door 25 may be provided at an upper end of a front surface of the door 25.

The drawer unit 40 serves to keep the container, in which the food is put, at a predetermined temperature. A drawer 41 in which the container is accommodated may be provided at the drawer unit 40. The drawer 41 may be inserted into or withdrawn from the cooking device 1 in a sliding method. A handle 42 gripped by the user may be provided at a front surface of the drawer 41.

The control unit 50 may receive an operation signal for operating the cooking device 1, specifically, an operation signal for operating at least one of the cook-top unit 60, the oven unit 20 and the drawer unit 40. Further, the control unit 50 may display a variety of information on the operation of the cooking device 1 to the outside.

Figure 3:
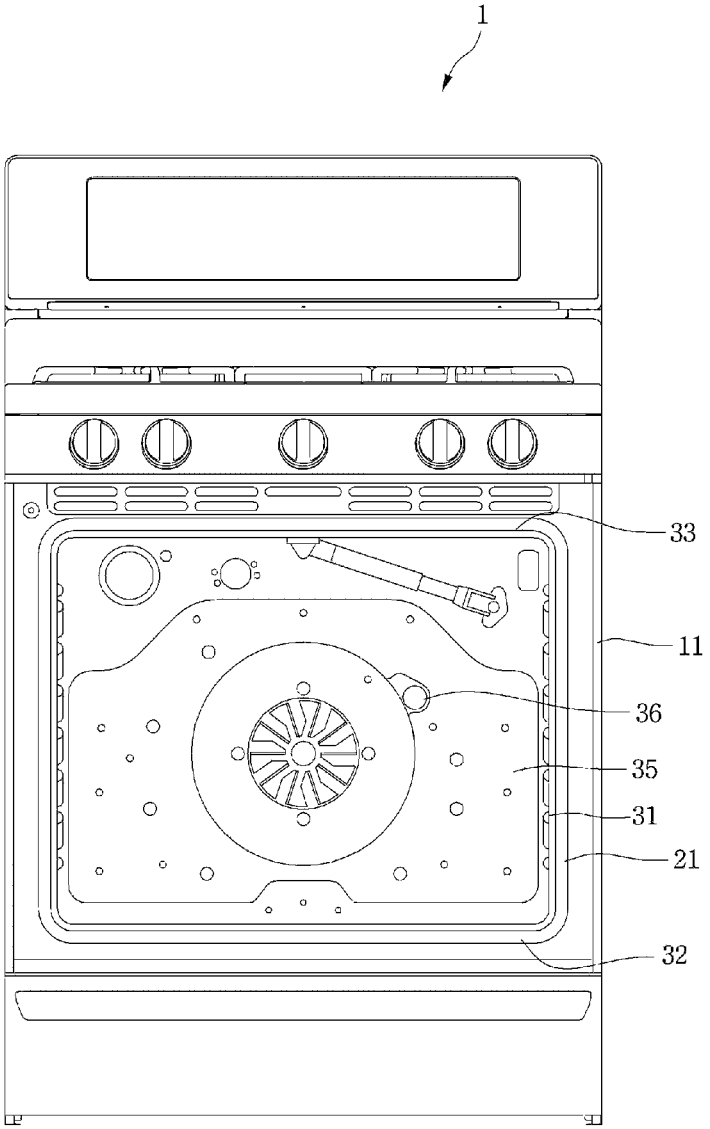
FIG. 3 is a view illustrating a state in which a burner assembly is removed from FIG. 2.
Figure 4:
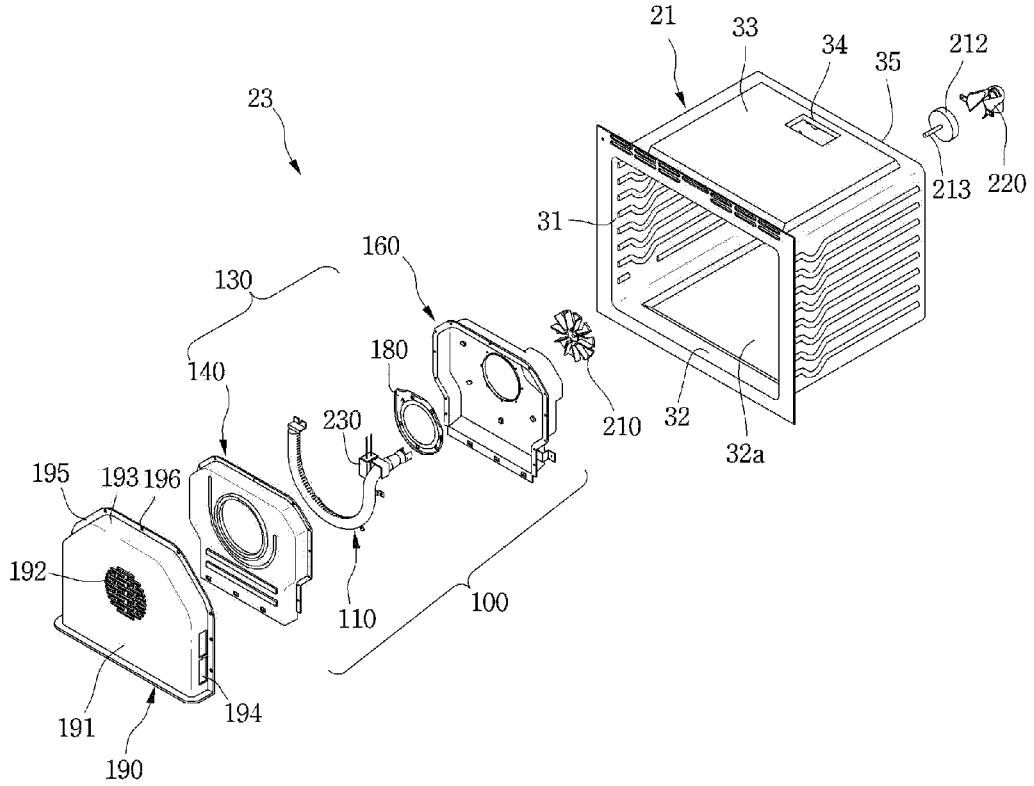
FIG. 4 is an exploded perspective view of the burner assembly according to one embodiment of the present invention.

FIG. 3 is a view when the burner assembly is removed from the cooking device shown in FIG. 2, and FIG. 4 is an exploded perspective view of the burner assembly according to the embodiment of the present invention.

Referring to FIGS. 2 to 4, the frame 21 may include two sidewalls 31, a bottom wall 32, an upper wall 33, and a rear wall 35.

In the embodiment, the term "front" is a direction toward a front surface of the cooking device 1, and the term "rear" is a direction toward a rear surface of the cooking device 1.

Further, in the cooking chamber 22, the term "front" is a direction toward the door 25 of the oven unit 20, and the term "rear" is a direction toward the rear wall 35 of the frame 21.

The burner assembly 23 may be coupled to the rear wall 35 of the frame 21. That is, in the embodiment, since the burner assembly 23 is not located under the frame 21 but is installed at the rear wall 35 of the frame 21, a recessed portion 32*a* recessed downward may be formed at the bottom wall 32 of the frame 21, and thus a capacity of the frame 21 may be increased.

Although the above-described burner assembly 23 is installed at the rear wall 35 of the frame 21, alternatively, the burner assembly 23 may also be installed at any one of both of the sidewalls 31 of the frame 21.

The burner assembly 23 may include a burner device 100. The burner device 100 may include a burner 110 which generates a flame by burning a gas, and a burner cover 130 which covers the burner 110.

The burner assembly 23 may further include an assembly cover 190 which covers the burner device 100.

The burner assembly 23 may further include a fan 210 and a fan motor 212.

In the embodiment, the term "located in a frame" refers to the term "located in a space in which the frame is formed."

A burner hole 36 through which the burner 110 passes may be formed in the rear wall 35 of the frame 21. That is, the burner 110 may be located in the frame 21 and a part thereof may pass through the burner hole 36 to be located between the rear wall 35 of the frame 21 and the outer case 11.

An exhaust hole 34 through which an exhaust gas is discharged may be formed in the upper wall 33 of the frame 21. Alternatively, the exhaust hole 34 may not be formed in the upper wall 33, but may also be formed in the rear wall 35 or one of both of the sidewalls 31 of the frame 21.

The burner cover 130 may include a first cover 140 and a second cover 160. For example, at least a part of the first cover 140 may cover the front of the burner 110, and at least a part of the second cover 160 may cover the rear of the burner 110.

The burner device 100 may further include an ignition unit 230 for igniting the mixed gas supplied to the burner 110.

The burner device 100 may further include a stabilizer 180 for stabilizing the flame generated from the burner 110.

For example, the ignition unit 230 may be installed on the burner 110 in the frame 21. When the ignition unit 230 is installed on the burner 110, at least a part of the ignition unit 230 may be located in the burner cover 130.

The fan motor 212 may be located between the rear wall 35 of the frame 21 and the outer case 11, and the fan 210 may be located in the frame 21. Therefore, a shaft 213 of the fan motor 212 may pass through the rear wall 35 of the frame 21 and may be coupled to the fan 210. The fan motor 212 may be fixed to the rear wall 35 of the frame 21 or the outer case 11 by a motor mount which is not shown.

The assembly cover 190 may protect the burner device 100. Further, the assembly cover 190 may block the movement of food leftovers or the like to the burner device 100 during a process of cooking food.

The assembly cover 190 may include a front plate 191, an extension part 193 extending from the front plate 191 toward the rear wall 35 of the frame 21, and a contact part 195 bent from the extension part 193.

An air suction hole 192 through which air within the cooking chamber 22 is suctioned is defined on the front plate 191, and an air discharge hole 194 through which air heated by the burner device 100 is discharged into the cooking chamber 22 is defined on the extension part 193. In another example, the air discharge hole 194 may be defined on the front plate 191 or defined on each of the front plate 191 and the extension part 193.

The contact part 195 may contact the rear wall 35 of the frame 21 in a state where the contact part 195 covers the burner device 100. A coupling hole 196 to which a coupling member (not shown) is coupled is defined on the contact part 195.

A lower end of the assembly cover 190 may contact the bottom wall 32 of the frame 21 in a state where the assembly cover 190 is coupled to the rear wall 35 of the frame 21 by the coupling member. That is, the front plate 191 and lower ends of the extension part 193 and the contact part 195 may contact the bottom wall 32 of the frame 21. Alternatively, the front plate 191 and the extension part 193 may contact the bottom wall 32 of the frame 21.

Here, the assembly cover 190 may contact the bottom wall 32 of the frame 21 between the recessed portion 32*a* of the bottom wall 32 and the rear wall 35 of the frame 21.

The burner assembly 23 may further include a nozzle holder 220 for spraying gas into the burner 110.

The nozzle holder 220 may be disposed between the rear wall 35 of the frame 21 and the outer case 11. For example, the nozzle holder 220 may be fixed to the rear wall 35 of the frame 21. In another example, if an insulator is disposed on the outside of the cavity 21, the nozzle holder 220 may be disposed on the insulator.

The nozzle holder 220 may be aligned with the burner 110 passing through the rear wall 35 of the frame 21 to spray gas into the burner 110.

Figure 5:
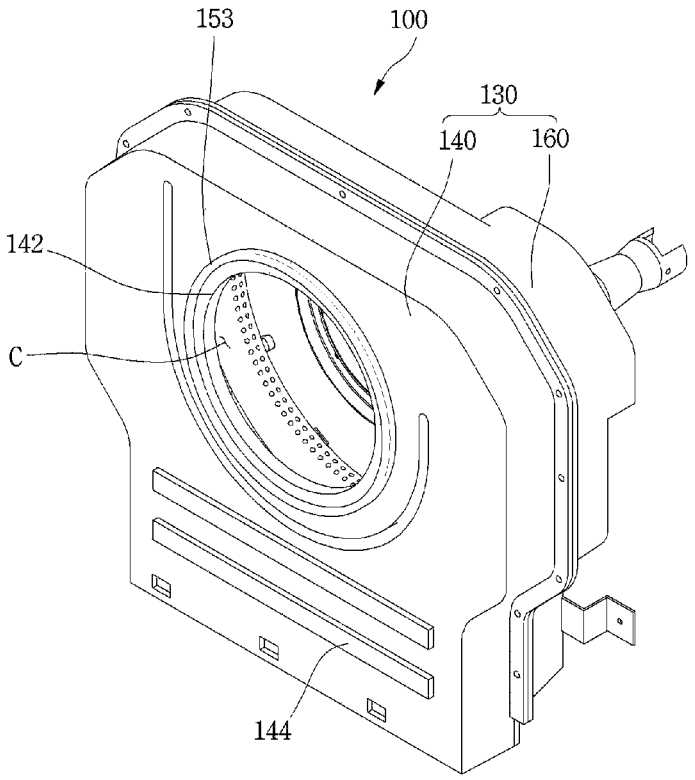
FIG. 5 is a perspective view of a burner device according to one embodiment of the present invention.
Figure 6:
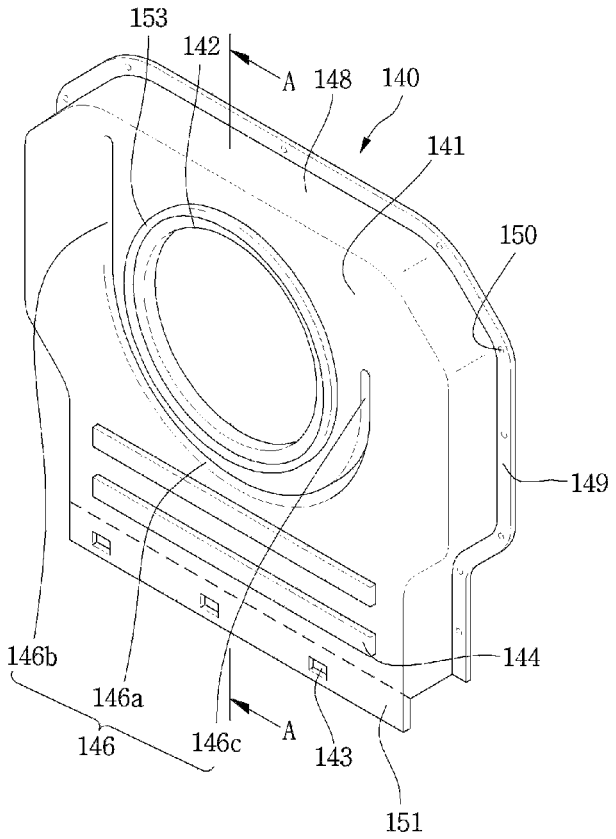
FIG. 6 is a perspective view of a first cover of the burner device of FIG. 5.
Figure 7:
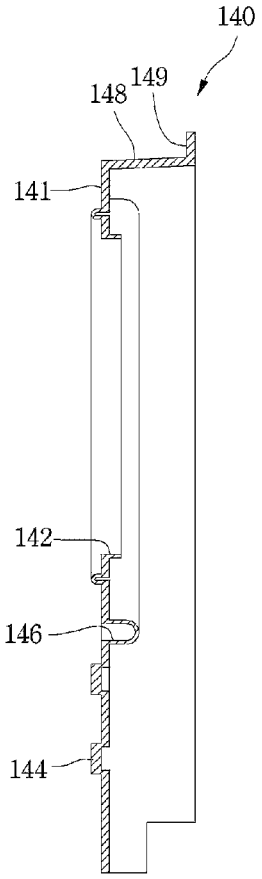
FIG. 7 is a cross-sectional view taken along line A-A of FIG. 6.

FIG. 5 is a perspective view of a burner device according to the embodiment of the present invention, FIG. 6 is a perspective view illustrating a first cover of the burner device of FIG. 5, and FIG. 7 is a cross-sectional view taken along line A-A' of FIG. 6.

Referring to FIGS. 4 to 7, the burner cover 130 includes a combustion chamber C in which gas is burned within the second chamber. Also, the burner 110 is disposed in the combustion chamber C.

As shown in FIG. 5, the burner cover 130 includes a first cover 140 and a second cover 160.

Referring to FIG. 6, the first cover 140 may include a first plate 141. The first cover may further includes a first extension part 148 extending backward from the first plate 141, and a first coupling part 149 bent from the first extension part 148.

The first plate 141 includes a first opening 142 (or inlet opening) through which air within the cooking chamber 22 passes, which is suctioned through the air suction hole 192 of the assembly cover 190.

The air suction hole 192 of the assembly cover 190 may have a grill shape (see FIG. 4). That is, the air suction hole 192 may be defined as a plurality of holes. However, the air suction hole 192 that is defined as the plurality of holes may have a circular shape on the whole profile.

Here, the first opening 142 may have a diameter equal to or greater than that of the profile of the air suction hole 192 so that the air passing through the air suction hole 192 smoothly passes through the first opening 142 of the first cover 140.

The first plate 141 may further include at least one first reinforcing part 144 for reinforcing strength of the first plate 141. The at least one first reinforcing part 144 is disposed under the first opening 142 on the first plate 141. The at least one first reinforcing part 144 may be disposed lengthwise in a horizontal direction. Although a plurality of first reinforcing parts 144 are vertically spaced apart from each other in FIG. 6, the current embodiment is not limited to the number and position of the first reinforcing part 144 shown. For example, the at least one first reinforcing part 144 may extend vertically lengthwise, and a plurality of first reinforcing parts 144 may be horizontally spaced apart from each other.

The first reinforcing part 144 may protrude forward from the first plate 141. That is, a portion of the first plate 141 may be formed so that the first reinforcing part 144 protrudes from the first plate 141 toward the door 25.

In the state where the assembly cover 190 is disposed on the rear wall 35 of the frame 21, the first reinforcing part 144 may contact the assembly cover 190. Alternatively, in the state where the assembly cover 190 is disposed on the rear wall 35 of the frame 21, the first reinforcing part 144 may be spaced apart from the assembly cover 190. In addition, when an external force is applied to the assembly cover 190, or the first plate 141 is expanded by heat, the first reinforcing part 144 may contact the assembly cover 190.

According to the current embodiment, the thermal deformation of the first plate 141 may be minimized by the first reinforcing part 144. Also, even though the first plate 141 is deformed, the first reinforcing part 144 may contact the assembly cover 190 to prevent the first plate 141 from being additionally deformed.

In another example, a portion of the plurality of first reinforcing part 144 may protrude forward from the first plate 141 toward the door 25, and another portion may protrude backward from the first plate 141. Alternatively, at least one first reinforcing part 144 may protrude backward from the first plate 141 toward the rear wall 35 of the cavity 21.

The first plate may further include a second reinforcing part 153 disposed on a circumferential part of the first opening 142 on the first plate 141 for reinforcing strength. For example, the first opening 142 may have a circular shape, and the second reinforcing part 153 may have a circular ring shape that surrounds the first opening 142. However, the current embodiment is not limited to the shape and number of the first opening 142 and the shape and number of the second reinforcing part 153.

The second reinforcing part 153 may protrude forward from the first plate 141. That is, a portion of the first plate 141 may be formed so that the second reinforcing part 153 protrudes from the first plate 141 toward the door 25.

In the state where the assembly cover 190 is disposed on the rear wall 35 of the frame 21, the second reinforcing part 153 may contact the assembly cover 190. In another example, in the state where the assembly cover 190 is disposed on the rear wall 35 of the frame 21, the second reinforcing part 153 may be spaced apart from the assembly cover 190. In addition, when an external force is applied to the assembly cover 190, or the first plate 141 is expanded by heat, the second reinforcing part 153 may contact the assembly cover 190.

The first opening 142 of the first plate 141 may be disposed to face the air suction hole 192 of the assembly cover 190. Thus, since air passing through the air suction hole 192 of the assembly cover 190 flows into the first opening 142 of the first plate 141 without being interfered in flow direction, the air may be smoothly circulated within the frame 21.

The first plate 141 may further include a first insertion part 151 having at least one first inflow hole 143 through which air is introduced into the combustion chamber C. For example, the at least one first inflow hole 143 may be defined under the first reinforcing part 144 in the first plate 141.

Although a plurality of first inflow holes 143 are horizontally spaced apart from each other in FIG. 6, the current embodiment is not limited to the number, position, and shape of the first inflow hole 143.

The first insertion part 151 may pass through the bottom wall 32 of the frame 21. Thus, the at least one first inflow hole 143 may be defined outside the frame 21.

Also, air outside the frame 21 may be supplied into the combustion chamber C through the at least one first inflow hole 143.

The first plate 141 may further include an air guide 146 for guiding the air supplied into the combustion chamber C to the flame generated at the burner 110 and to increase a contact time between the air and the flame.

The air guide 146 may protrude backward from the first plate 141. That is, a portion of the first plate 141 may be formed so that the air guide 146 protrudes from the first plate 141 toward the rear wall 35 of the frame 21.

The air guide 146 may include a curved part **146*a* and linear parts 146*b* and 146*c* defined on one end or both ends of the curved part 146*a*. Alternatively, the air guide 146 may include only the curved part 146*a***.

For example, the curved part **146*a* of the air guide 146 may have an arc shape. The curved part 146*a* may have a radius greater than that of the second reinforcing part 153**.

Thus, a portion of the curved part **146*a* may be disposed between the second reinforcing part 153 and the first reinforcing part 144. A distance between a center of the first opening 142 and the curved part 146*a* may shorter than a radius of an inner periphery surface of the burner 110. Thus, the air introduced into the combustion chamber C may be guided to the flame of the burner 110 by the air guide 146**.

The air guide 146 may be integrated with the first plate 141 or coupled to the first plate 141.

Also, the air guide 146 may have a curved shape in at least a section to smoothly guide the air flow.

At least one first coupling hole 150 that is coupled to the second cover 160 by a coupling member may be defined on the first coupling part 149.

Figure 8:
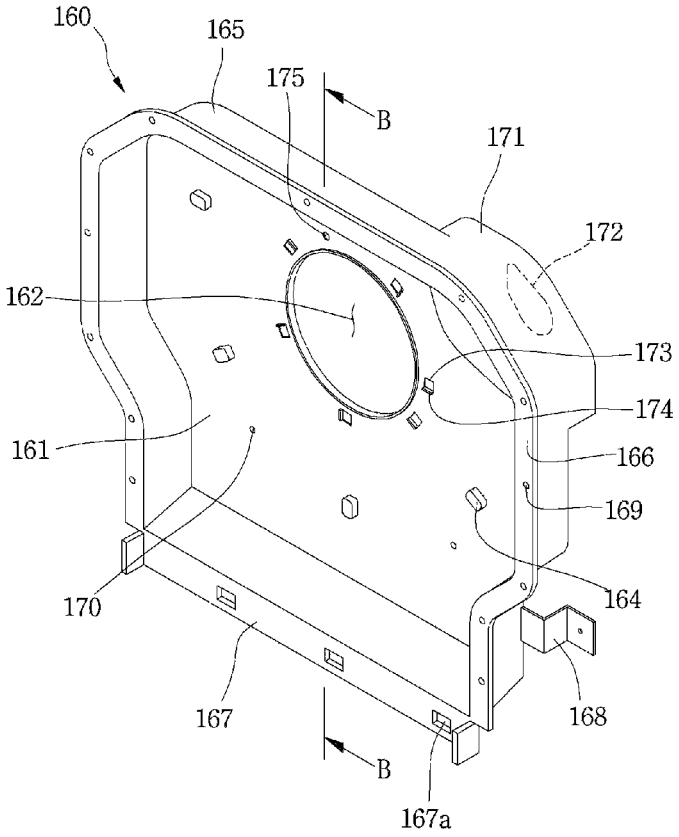
FIG. 8 is a perspective view of a second cover of the burner device of FIG. 5.
Figure 9:
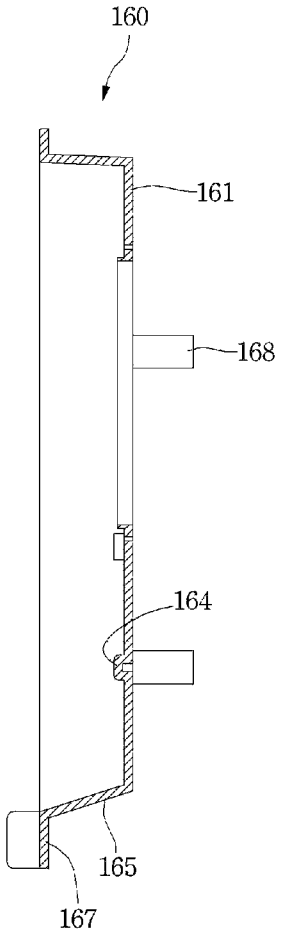
FIG. 9 is a cross-sectional view taken along line B-B of FIG. 8.

FIG. 8 is a perspective view illustrating a second cover of the burner device of FIG. 5, and FIG. 9 is a cross-sectional view taken along line B-B' of FIG. 8.

Referring to FIGS. 4, 5, 8, and 9, the second cover 160 may include a second plate 161.

The second cover 160 may further include a second extension part 165 extending forward from the second plate 161, and a second coupling part 166 bent from the second extension part 165.

The second plate 161 may include a second opening 162 (or outlet opening) through which air heated in the combustion chamber C is discharged. The second opening 162 may have a circular shape, but is not limited thereto. The second opening 162 may have a diameter less than that of the first opening 142.

The second plate 161 may include a burner coupling hole 170 to which the burner 110 is coupled. Also, The second plate 161 may include at least one protrusion 164 for preventing the burner 110 from directly contacting the second plate 161.

The at least one protrusion 164 may protrude to the burner 110 in the state where the burner 110 is disposed on the second plate 161. That is, a portion of the second plate 161 may be formed so that the at least one protrusion 164 protrudes toward the burner 110.

For example, the at least one protrusion 164 may contact the burner 110. In another example, the at least one protrusion 164 may be adjacent to the burner 110 in a state where the protrusion 164 is spaced apart from the burner 110. Also, when an external force is applied to the burner 110, or the second plate 161 is expanded by heat, the at least one protrusion 164 may contact the burner 110. Thus, in either event, the at least one protrusion may prevent the burner 110 from directly contacting the second plate 161.

Also, in case of the current embodiment, the at least one protrusion 164 may be disposed on the second plate 161 to minimize thermal deformation of the second plate 161.

In the state where the burner 110 is disposed on the second cover 160, and the first cover 140 is coupled to the second cover 160, the burner 110 may be spaced apart from the first plate 141 of the first cover 140 and the second plate 161 of the second cover 160. Thus, air outside the frame 21, which is introduced into the combustion chamber C may flow between the first plate 141 and the burner 110, and between the second plate 161 and the burner 110.

When the plurality of protrusions 164 are disposed on the second plate 161, the plurality of protrusions 164 may disposed to overlap the burner 110 in forward and backward directions when the burner 110 is disposed on the second cover 160.

The second plate 161 may further include at least one stabilizer coupling hole 175 to which the stabilizer 180 is coupled.

The second coupling part 166 may include at least one second coupling hole 169 to which the coupling member passing through the first coupling hole 150 of the first coupling part 149 is coupled.

In another example, the first and second coupling parts may not be disposed on the first and second covers, respectively. Also, the first extension part 148 of the first cover 140 and the second extension part 165 of the second cover 160 may be coupled to each other by a coupling member.

The second cover 160 may further include a second insertion part 167 passing through the bottom wall 32 of the frame 21. At least one second inflow hole 167*a* may be defined on the second insertion part 167. Thus, the at least one second inflow hole 167*a* may be disposed outside the frame 21.

Also, air outside the frame 21 may be supplied into the combustion chamber C through the at least one second inflow hole 167*a*.

In the state where the first cover 140 is coupled to the second cover 160, at least a portion of the first insertion part 151 of the first cover 140 may be spaced apart from the second insertion part 167 of the second cover 160.

Although a plurality of second inflow holes 167*a* are horizontally spaced apart from each other in FIG. 8, the current embodiment is not limited to the number, position, and shape of the second inflow hole 167*a*.

According to the current embodiment, the air outside the frame 21 may smoothly flow into the combustion chamber C by the at least one first inflow hole 143 defined on the first cover 140 and the at least one second inflow hole 167*a* defined on the second cover 160.

The second cover 160 may further include at least one installation part 168 for installing the second cover 160 on the rear wall 35 of the frame 21.

The installation part 168 may be disposed on the second plate 161, but is not limited thereto. Thus, the second plate 161 may be spaced apart from the rear wall 35 of the frame 21 in the state where the second cover 160 is disposed on the rear wall 35 of the frame 21 due to the installation of the installation part 168. Also, the fan 210 may be disposed in a space between the second plate 161 and the rear wall 35 of the frame 21. That is, the fan 210 may be disposed in a separate space outside the combustion chamber C on which the burner cover 130 is disposed.

The second cover 160 may further include a burner through-part 171 through which a portion of the burner 110 passes. The burner through-part 171 may protrude backward from the second plate 161 toward the rear wall 35 of the cavity 21, but is not limited thereto. That is, the second plate 161 may be deformed so that the burner through-part 171 protrudes backward from the second plate 161.

Also, a burner through-hole 172 may be defined on the burner through-part 171. The burner through-hole 172 may be aligned with the burner hole 36 defined on the rear wall 35 of the frame 21.

In the state where the second cover 160 is installed on the rear wall 35 of the frame 21, the burner through-part 171 may contact the rear wall 35 of the frame 21.

The heated air passing through the second opening 162 of the burner cover 130 may flow into a space between the second cover 160 and the rear wall 35 of the frame 21 and then be discharged into the cooking chamber 22 through the air discharge hole 194 of the assembly cover 190.

Here, in the state where the second cover 160 is disposed on the rear wall 35 of the frame 21, the burner through-part 171 may contact the rear wall 35 of the frame 21 to prevent the heated air from being reintroduced into the combustion chamber C through the burner through-hole 172.

The second cover 160 may include one or more hook coupling holes 173 which are fastened with a hook described later of the stabilizer 180.

The one or more hook coupling holes 173 may be formed on the second plate 161.

A plurality of hook coupling holes 173 may be coupled to the second plate 161 so that the stabilizer 180 is firmly coupled to the second cover 160.

The second cover 160 may further include an erroneous assembly preventing unit 174 for preventing erroneous assembly of the stabilizer 180. The erroneous assembly preventing unit 174 may be a stopper which protrudes from the second plate 161. For example, the erroneous assembly preventing unit 174 may protrude toward the stabilizer 180 from the second plate 161. That is, the erroneous assembly preventing unit 174 may protrude toward the front of the cooking chamber from the second plate 161.

The erroneous assembly preventing unit 174 may be located around the hook coupling hole 173.

Figure 10:
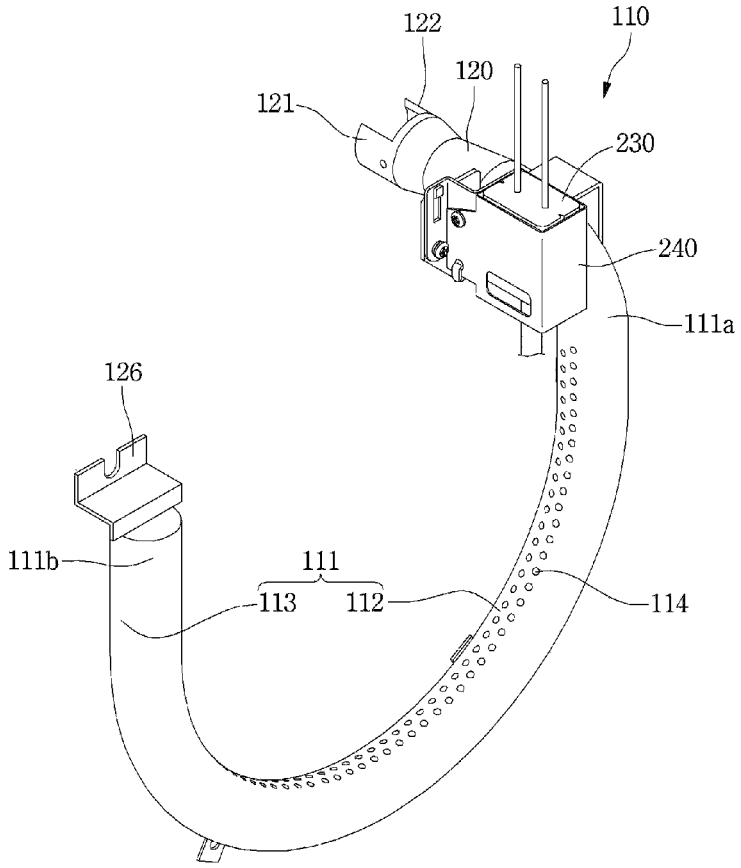
FIG. 10 is a view illustrating a state in which an ignition unit is installed at a burner according to one embodiment of the present invention.

FIG. 10 is a perspective view of a burner on which an ignition unit is installed.

Referring to FIG. 10, the burner 110 according to the embodiment of the present invention includes a burner tube 111 having both ends spaced apart from each other. That is, in the current embodiment, the burner tube 111 may have a non-annular shape.

The burner tube 111 may have a "U" shape, but is not limited thereto. A supply part 120 for receiving gas and air may be disposed on a first end 111*a* of the burner tube 111, and a second end 111*b* of the burner tube 111 may be blocked.

The supply part 120 may inclinedly extend from the first end 111*a* of the burner tube 111. The gas and air supplied through the supply part 120 changes in flow direction from the first end 111*a* toward the second end 111*b* along the burner tube 111.

That is, in the current embodiment, the gas and air supplied through the supply part 120 may flow only in one direction within the burner tube 111.

The burner tube 111 may be formed in a curved shape on the whole, or at least one of the first and second ends 111*a* and 111*b* may be formed a straight-line shape, and the other section may be formed in a curved shape.

The burner tube 111 may include an inner periphery 112 and an outer periphery 113.

In the current embodiment, since the burner tube 111 has a "U" shape, the inner periphery 112 or the outer periphery 113 may have a plurality of curvatures different from each other. That is, the curvature of the inner or outer peripheries 112 and 113 of the burner tube 111 may vary in a longitudinal direction of the burner tube 111.

A plurality of gas outlet holes 114 are defined on the inner periphery 112 of the burner tube 111. The plurality of gas outlet holes 114 are disposed in a plurality of rows. In the current embodiment, the "row" may represent a set of gas outlet holes that are arranged in a direction corresponding to the extension direction of the burner tube 111.

Although the gas outlet holes 114 arranged in two rows are defined on the inner periphery 112 of the burner tube 111 in FIG. 10, the current embodiment is not limited to the number of rows of the gas outlet holes. That is, the gas outlet holes arranged in a single row may be defined on the inner periphery 112 of the burner tube 111.

The gas outlet holes 114 arranged in one row may be spaced apart from each other in the longitudinal direction of the burner tube 111. Also, the gas outlet holes 114 arranged in one row may be spaced apart from the gas outlet holes 114 arranged in the other row.

Although not limited thereto, the gas outlet holes 114 adjacent to each other may be disposed in a zigzag form so that flames generated in the gas outlet holes 114 and 115 that are adjacent to each other and arranged in two rows do not interfere with each other.

That is, the gas outlet holes 114 arranged in the other row may be disposed in a region corresponding to that between the gas outlet holes 114 adjacent to each other and arranged in one row.

Also, the inner periphery 112 of the burner tube 111 may have a radius greater than a radius of the second opening 162 of the second cover 160. When the second opening 162 has the non-annular shape, the inner periphery 112 of the burner tube 111 may have a radius greater than a maximum radius of the second opening 162.

At least one bracket 126 for installing the burner tube 111 on the second cover 160 may be disposed on the burner tube 111.

Although the at least one bracket 126 are coupled to the second cover 160 by using a screw, the current embodiment is not limited to the coupling method between the least one bracket 126 and the second cover 160.

In the state where at least one bracket 126 is coupled to the second cover 160, the burner tube 111 may be spaced apart from the second plate 161 of the second cover 160.

The supply part 120 may include a plurality of guides 121 and 122 for aligning the supply part 120 with the nozzle holder 220. The plurality of guides 121 and 122 may be spaced apart from each other, and air outside the frame 21 may be introduced into the supply part 120 together with the gas sprayed from the nozzle holder 220 through the space between the plurality of guides 121 and 122.

The supply part 120 may pass through the burner through-hole 172 of the second cover 160 and the burner hole 36 of the rear wall 35 of the frame 21.

According to the embodiment, since the plurality of gas outlet holes are formed at an inner periphery of the burner 110, and the air passes through an area formed by the plurality of gas outlet holes, the air in the cooking chamber 22 may be sufficiently heated by heat of the flame of the burner 110.

Also, since the flame is generated at the inner periphery of the burner 110, a distance between the flames is reduced, as it becomes distant from the gas outlet holes, and thus a phenomenon in which the flame is extinguished due to the flow of the air may be prevented.

A relative position of the ignition unit 230 with respect to the burner 110 may be fixed by a fixing device 240.

Figure 11:
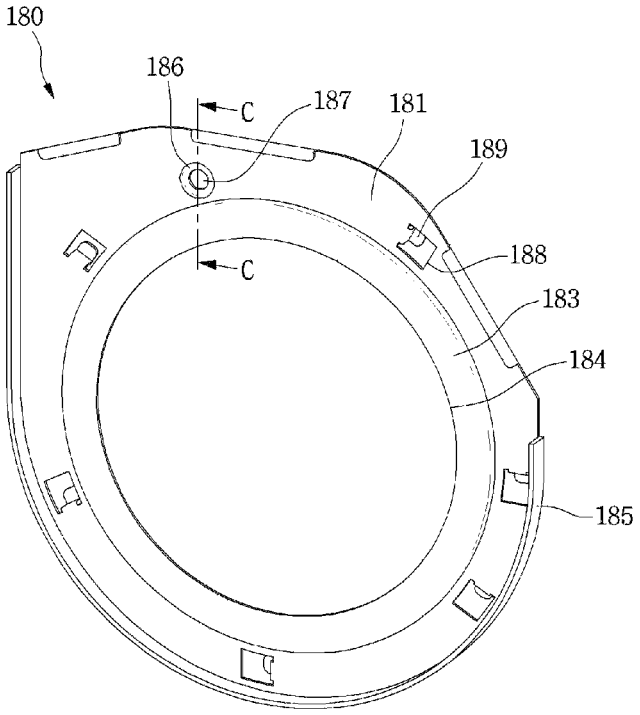
FIG. 11 is a perspective view of a stabilizer according to one embodiment of the present invention.
Figure 12:
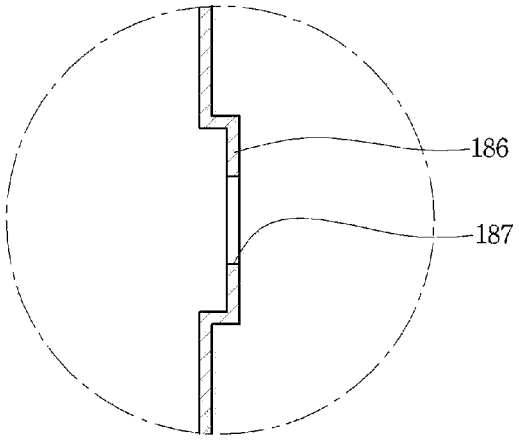
FIG. 12 is a cross-sectional view taken along line C-C of FIG. 11.
Figure 13:
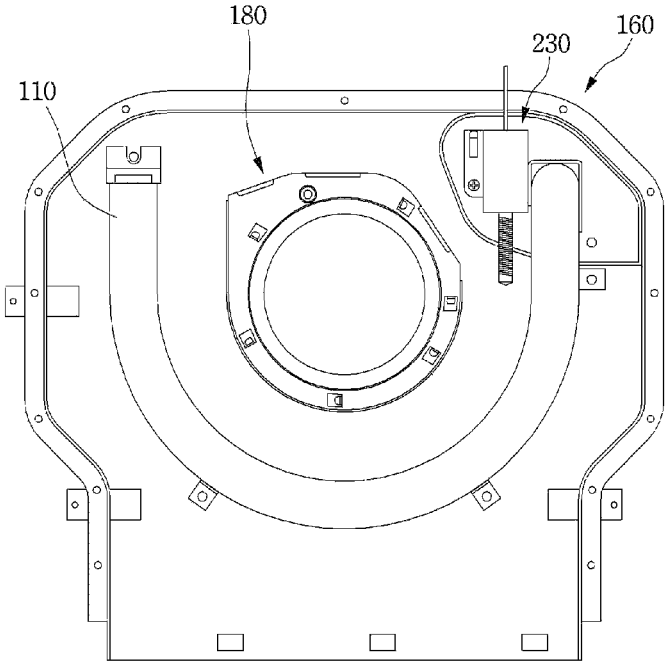
FIG. 13 is a perspective view illustrating a state in which the stabilizer and the burner are installed at a second cover according to one embodiment of the present invention.
Figure 14:
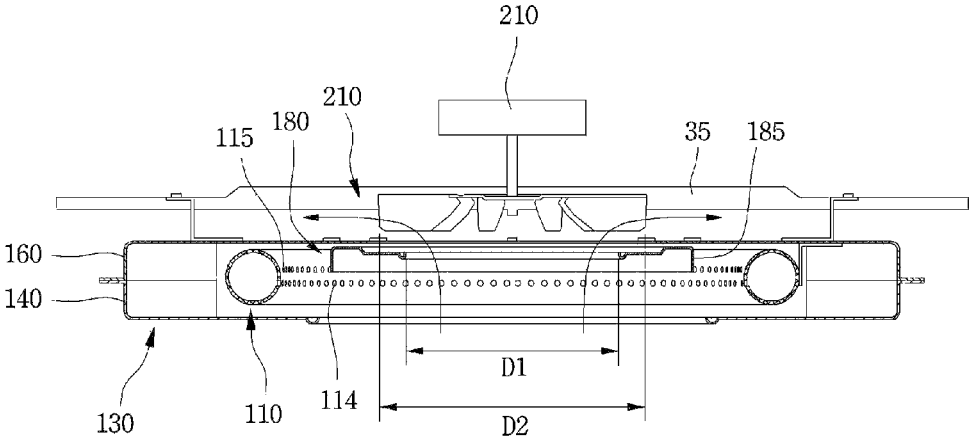
FIG. 14 is a cross-sectional view illustrating a state in which a burner device is installed at a frame according to a first embodiment of the present invention.

FIG. 11 is a perspective view of a stabilizer according to one embodiment of the present invention, FIG. 12 is a cross-sectional view taken along line C-C of FIG. 11, FIG. 13 is a perspective view illustrating a state in which the stabilizer and the burner are installed at a second cover according to one embodiment of the present invention, and FIG. 14 is a cross-sectional view illustrating a state in which a burner device is installed at a frame according to a first embodiment of the present invention.

Referring FIGS. 8, 11 to 14, the stabilizer 180 may be fastened to the second cover 160. That is, the stabilizer 180 may be fastened to the second cover 160 in the combustion chamber C.

For example, the stabilizer 180 may be formed of a stainless material, but is not limited thereto.

The stabilizer 180 may include a body 181. For example, the body 181 may be formed in a circular ring shape, but is not limited thereto.

The body 181 may include a forming unit 183 which is formed in a direction away from the fan 210, so as to increase a gap between the body 181 and the fan 210. Based on a state in which the stabilizer 180 is installed, the forming unit 183 may be described to be formed in a direction towards the first cover 140.

An opening 184 through which an air passes is formed in the forming unit 183.

A diameter D1 of the opening 184 may be formed smaller than an outer diameter D2 of the fan 210. The diameter D1 of the opening 184 is smaller than a diameter of the second opening 162 of the second cover 160. Therefore, while being spaced apart from the fan 210, the forming unit 183 covers a portion of a front surface of the fan 210.

A barrier 185 which is configured to reduce an influence of an air flowing through the combustion chamber C on a flame of the burner 110, is provided in an outer end of the body 181. The barrier 185 may be extended vertically toward the first cover 140 from the body 181.

For example, while in a state in which the stabilizer 180 and the burner 110 are installed on the second cover 160, the barrier 185 is extended from the body 181 to a position adjacent to a gas outlet hole 114 of the burner 110.

A radius of the barrier 185 is smaller than a radius of the inner periphery 112 of the burner tube 111. Accordingly, the barrier 185 is spaced apart from the inner periphery 112 of the burner tube 111.

The forming unit 183 is located within an area formed by the barrier 185. Therefore, an air introduced into the combustion chamber C passes through the opening 184 of the forming unit 183 within the area formed by the barrier.

Accordingly, a flame generated in the gas outlet hole 114 may crash into the barrier 185. While the air in the combustion chamber C passes through the opening 184, since a flame generated in the gas outlet hole 114 should climb aboard the barrier 185, the flame may be prevented from passing through the opening 184 of the stabilizer 180 and being in contact with the fan 210.

In the case of absence of the barrier 185, by the air which is passing through the combustion chamber C, since a flame generated in the gas outlet hole 114 contacts the fan 210, the fan 210 is heated, and by heat of the flame, the rear wall 35 of the frame 21 is heated, and thus the fan 210 and the rear wall 35 of the frame 21 may be seared.

In a case that the fan 210 and the rear wall 35 of the frame 21 are seared, the fan 210 or the rear wall 35 is deformed so that an air does not flow smoothly or a rotation center of the fan 210 and a center of the opening 184 of the stabilizer 180 may not be aligned so that the air passes partially rather than uniformly through the opening 184, and thus a flow bias may be generated.

However, according to an embodiment, since the flame generated in the gas outlet hole 114 is directed toward the forming unit 183 after hitting against the barrier, the fan 210 and the rear wall 35 of the frame 21 may be prevented from being seared by flame.

In addition, since the flame generated in the gas outlet hole 115 primarily hits against the barrier 185, the flame is stabilized, and there is an advantage of improving the heating performance of the air.

Also, even if a flame generated in the burner 110 is affected by the flow of air, since an end of the flame is located in the forming unit 183 side of the stabilizer 180, the air passing through the opening 184 of the stabilizer 180 may be effectively heated.

In addition, since the flame generated in the gas outlet hole 114 heats the barrier 185, the barrier 185 is heated redly so that the user may recognize easily that the burner assembly 23 is operating.

Also, since an air flow distance between the fan 210 and the forming unit 183 is increased by the forming unit 183, the amount of the air which is discharged into the cooking chamber 22 after passing through the combustion chamber C is increased, and thus a circulation of heated air within the cooking chamber 22 becomes smooth, thereby heating the food in the cooking chamber 22 quickly.

In addition, since an air flow space between the fan 210 and the forming unit 183 and a space between the forming unit 183 and a rear side wall of the frame 21 are increased by the forming unit 183, a flow rate of air passing through the combustion chamber C is increased, and thus a flow rate of the air which is introduced into the combustion chamber C from the outside of the frame 21 is increased. Therefore, the incomplete combustion of gas is decreased in the burner 110 and thus the amount of carbon monoxide in the cooking chamber 22 is minimized.

The stabilizer 180 may further include a fastening unit 186 to be fastened by the second cover 160 and a fastening member. The fastening unit 186 may protrude toward the second cover 160 from the body 181. A cover fastening hole 187 for the fastening member to pass therethrough, may be formed in the fastening unit 186.

The fastening unit 186 may contact the second plate 161 of the second cover 160, and the body 181 may be spaced apart from the second plate 161 while the fastening unit 186 is in contact with the second plate 161.

The stabilizer 180 may further include one or more hooks 189 for fastening with the second cover 160. The one or more hooks 189 may protrude toward the second cover 160 from the body 181.

For firmly fastening the stabilizer 180 to the second cover 160, a plurality of hooks 189 may be provided on the body 181. In a case that the plurality of hooks 189 are provided on the body 181, in order to prevent erroneous assembly, a gap between the plurality of hooks 189 may be arranged non-uniformly. That is, a distance between two adjacent hooks may be different from a distance between other two adjacent hooks.

A portion of the body 181 is cut away to form the hook 189, and the hook 189 may be substantially formed in a shape such as "L". That is, the body 181 may include an incision unit 188 for forming the hook 189.

In the present embodiment, when the fastening member is fastened to the fastening unit 186 and the second plate 161 while the fastening unit 186 is in contact with the second plate 161, a remaining portion of the body 181 except the fastening unit 186 may maintain a state being spaced apart from the second plate 161.

At this time, it is preferable that the stabilizer 180 has a single fastening unit 186 so as to minimize a contact surface of the stabilizer 180 and the second cover 160.

Figure 15:
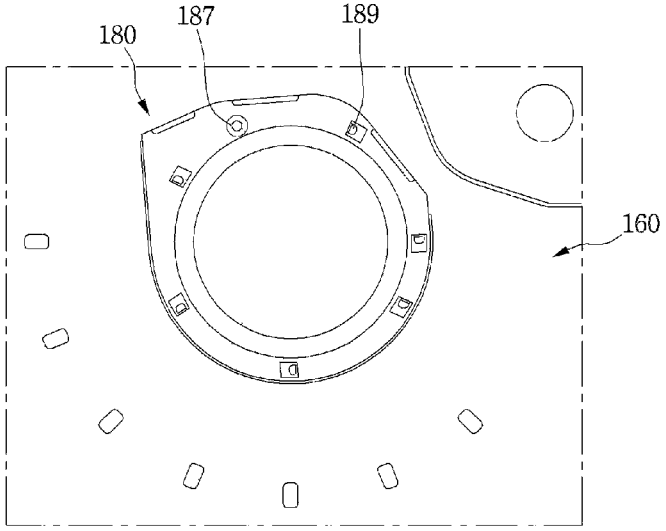
FIGS. 15 and 16 are views illustrating a process in which the stabilizer is fastened to the second cover.
Figure 16:
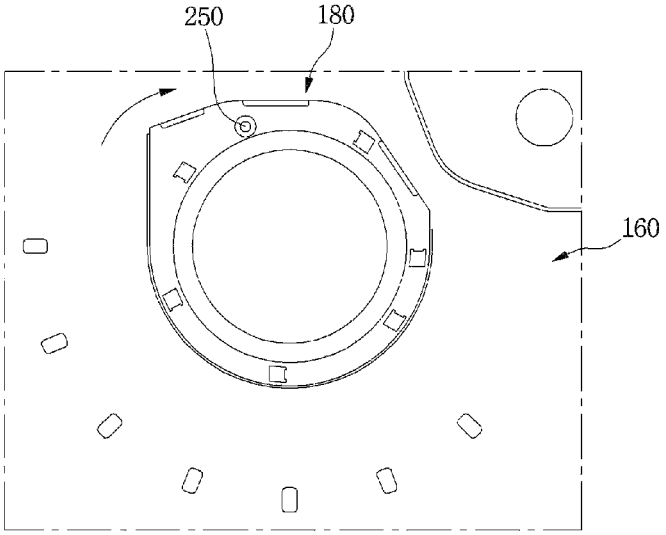
Figure 17:
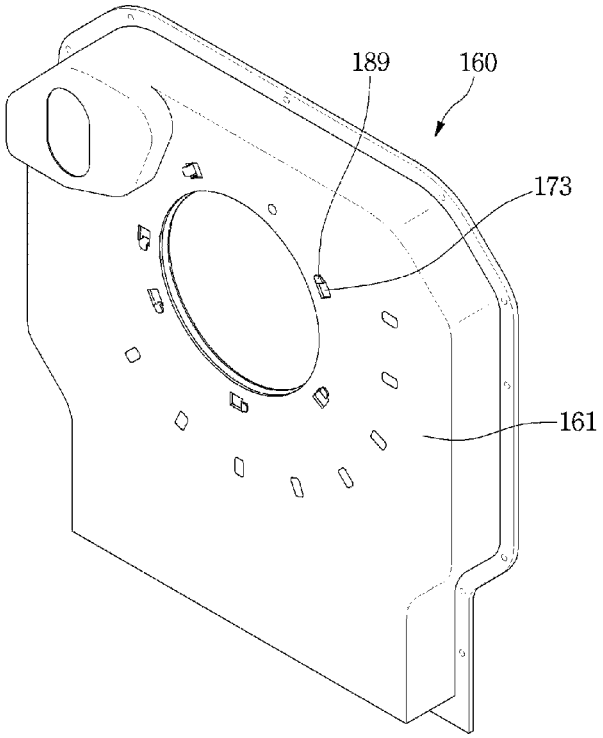
FIG. 17 is a view illustrating a state in which a hook of the stabilizer is fastened to the second cover.
Figure 18:
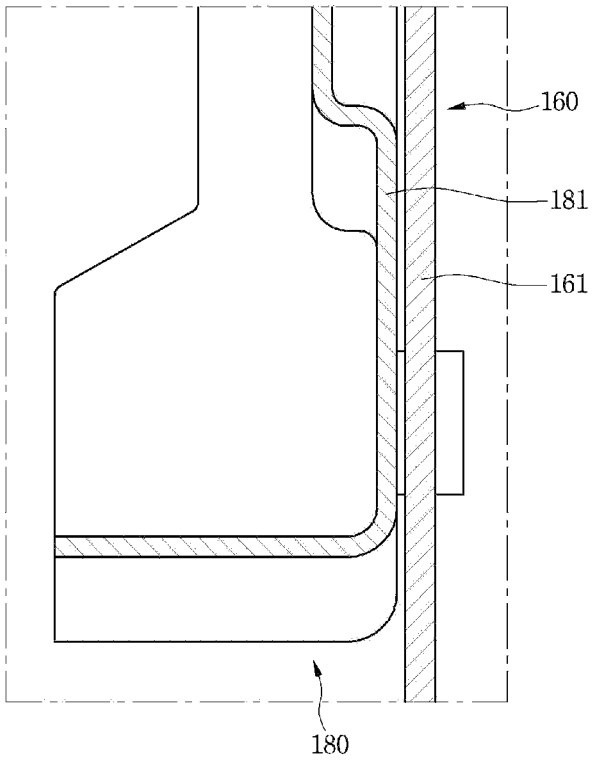
FIG. 18 is a cross-sectional view illustrating a state in which a body of the stabilizer is spaced apart from the second cover while the stabilizer is installed at the second cover.
Figure 19:
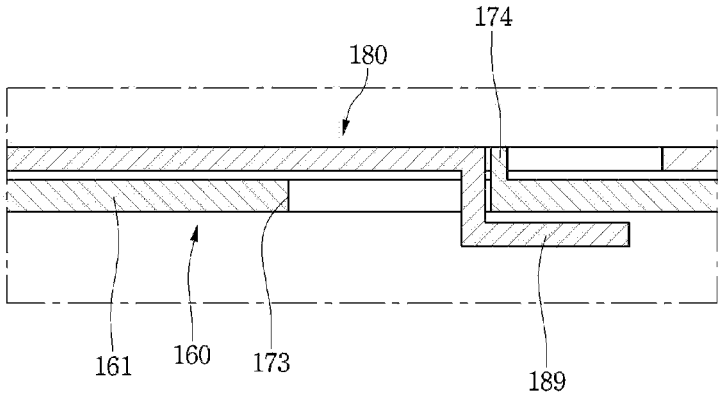
FIG. 19 is a view illustrating a state in which the stabilizer is normally coupled to the second cover.
Figure 20:
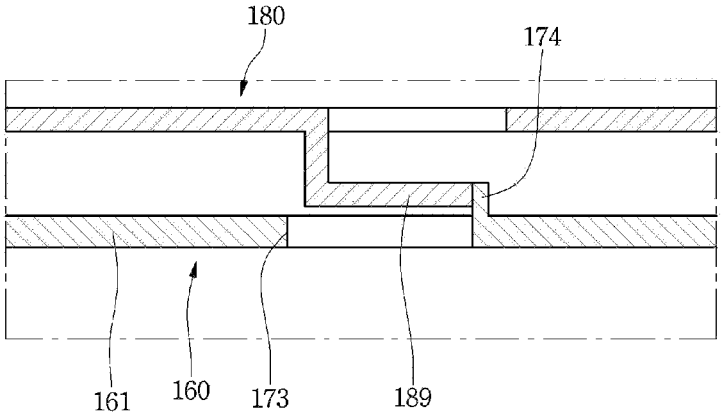
FIG. 20 is a view illustrating a state in which the stabilizer is prevented from being fastened while the hook of the stabilizer has not penetrated a hook coupling hole.

FIGS. 15 and 16 are views illustrating a process in which the stabilizer is fastened to the second cover, FIG. 17 is a view illustrating a state in which a hook of the stabilizer is fastened to the second cover, FIG. 18 is a cross-sectional view illustrating a state in which a body of the stabilizer is spaced apart from the second cover while the stabilizer is installed at the second cover, FIG. 19 is a view illustrating a state in which the stabilizer is normally coupled to the second cover, and FIG. 20 is a view illustrating a state in which the stabilizer is prevented from being fastened while the hook of the stabilizer has not penetrated a hook coupling hole.

Referring FIGS. 15 to 20, in order to couple the stabilizer 180 to the second cover 160, the hook 189 of the stabilizer 180 and the hook coupling hole 173 of the second cover 160 are aligned. Here, even if the hook 189 is aligned with the hook coupling hole 173, the cover fastening hole 187 and the stabilizer fastening hole 175 are not aligned.

Then, the hook 189 of the stabilizer 180 is allowed to penetrate the hook coupling hole 173 of the second cover 160.

Subsequently, the stabilizer 180 is rotated in one direction, a clockwise direction in the drawing. Then, the hook 189 is hung on the second plate 161 and the stabilizer 180 is primarily fixed to the second cover 160.

While the stabilizer 180 is rotated in one direction, the cover fastening hole 187 and the stabilizer fastening hole 175 are aligned. And, finally the fastening member 250 is fastened to the cover fastening hole 187 and the stabilizer fastening hole 175. At this time, a fastening boss which protrudes toward the rear wall 35 of the frame 21 from the stabilizer fastening hole 175 may be provided in the second cover 160 so as to increase the fastening force with the fastening member 250.

As shown in FIG. 19, while the hook 189 of the stabilizer 180 normally penetrates the hook coupling hole 173, since the hook 189 is not interfered with the erroneous assembly preventing unit 174 of the second cover 160, the stabilizer 180 may be normally rotated. At this time, the erroneous assembly preventing unit 174 may be inserted into the incision unit 188 of the stabilizer 180. Accordingly, while the hook 189 of the stabilizer 180 normally penetrates the hook coupling hole 173, an interference between the stabilizer 180 and the erroneous assembly preventing unit 174 is prevented.

On the other hand, as shown in FIG. 20, when the stabilizer 180 is rotated while the hook 189 of the stabilizer 180 does not penetrate the hook coupling hole 173, the hook 189 is in contact with the erroneous assembly preventing unit 174 and then a rotation of the stabilizer 180 is restricted, and accordingly, the stabilizer 180 may be prevented from being erroneously assembled to the second cover 160.

When the stabilizer 180 includes a plurality of hooks 189, rotation of the stabilizer 180 is restricted unless any one of the plurality of hooks 189 does not normally penetrate the hook coupling hole 173, and thus the stabilizer 180 may be prevented from being erroneously assembled to the second cover 160.

If the erroneous assembly preventing unit 174 is not provided in the second cover 160, the stabilizer 180 can be rotated even if the hook 189 of the stabilizer 180 does not penetrate the hook coupling hole 173. In this case, the stabilizer 180 and the second cover 160 are erroneously assembled and a gap between the stabilizer 180 and the second cover 160 is increased by the hook 189, and thus a flame flows between the stabilizer 180 and the second cover 160, and furthermore, air may not flow smoothly in the combustion chamber.

According to an embodiment, while the stabilizer 180 is fastened to the second cover 160, a remaining portion of the body 181 except the fastening unit 186 may be spaced from the second cover 160. That is, there may be a gap between the body 181 and the second plate 161.

The stabilizer 180 and the second cover 160 may be thermally deformed (thermal expansion or thermal contraction) by a flame generated from the burner, and if the body 181 of the stabilizer 180 and the second plate 161 are in contact with each other, a friction noise by the thermal deformation of the body 181 of the stabilizer 180 and the second plate 161 is generated. This friction noise is even more serious when materials of the stabilizer 180 and the second cover 160 are different.

However, in the present embodiment, since there is a gap between the body 181 and the second plate 161, even if the stabilizer 180 and the second cover 160 are thermally deformed, a state in which the body 181 and the second plate 161 are spaced apart is maintained or an increase of a contact area between the body 181 and the second plate 161 is minimized, and thus generation of the friction noise may be minimized.

However, a gap between the body 181 and the second plate 161 may be 1 mm and less, in order to prevent a flame of the burner from passing through the space between the body 181 and the second plate 161.

Figure 21:
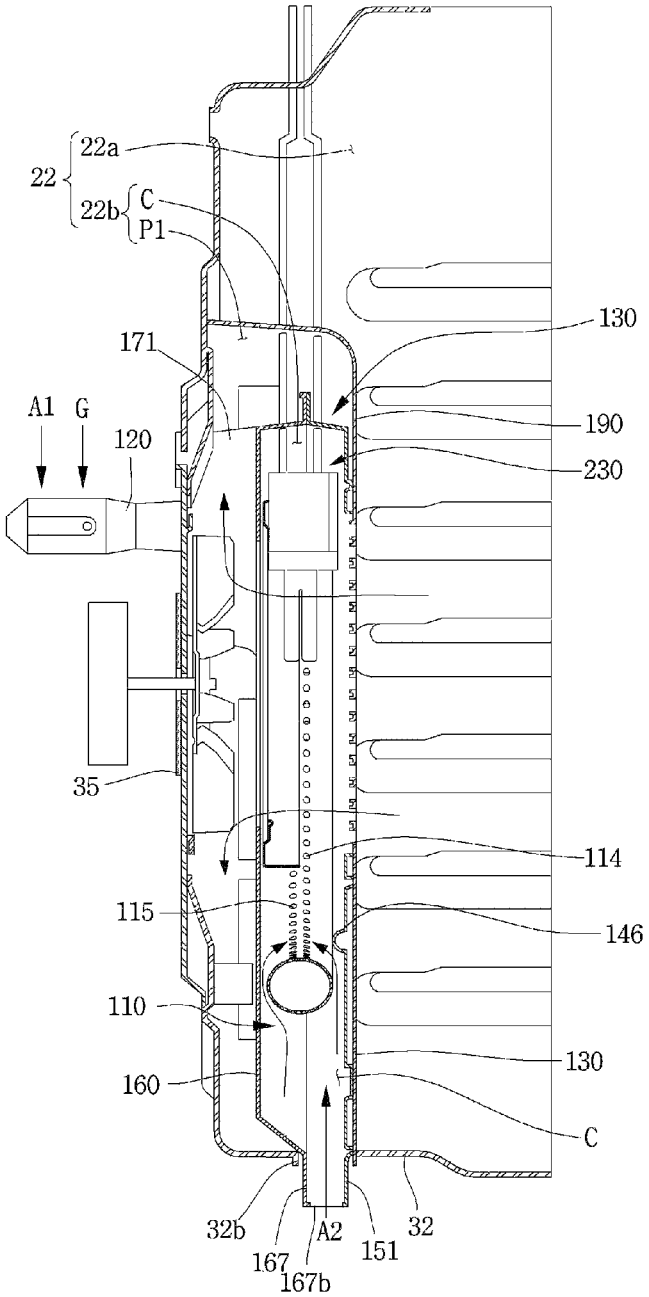
FIG. 21 is a vertical sectional view illustrating a state in which the burner assembly is installed at the frame according to one embodiment of the present invention.

FIG. 21 is a vertical sectional view illustrating a state in which the burner assembly is installed at the frame according to one embodiment of the present invention.

Referring to FIG. 21, a penetration hole 32*b* through which the insertion parts 151 and 167 of the burner cover 130 pass may be formed in the bottom wall 32 of the frame 21. Therefore, as the insertion parts 151 and 167 of the burner cover 130 penetrate the penetration hole 32*b*, the insertion parts 151 and 167 may be located on the outside of the frame 21.

At least a portion of the first insertion part 151 and the second insertion part 167 are spaced apart from each other and may form a third inflow hole 167*b*.

Also, the fan 210 is disposed in an exhaust passage P1 which is the outer space of the combustion chamber C. The exhaust passage P1 may be formed by an outer surface of the burner cover 130, the rear wall 35 of the frame 21 and the assembly cover 190.

Accordingly, in the present invention, a plurality of gas outlet holes 114 and 115 are formed in the inner periphery of the burner 110, and as the fan 210 is disposed in the combustion chamber C and the separate exhaust passage P1, the fan 210 may be prevented from being heated by a flame of the burner 110. In addition, as the flame and air of the burner 110 flow toward the fan 210 after contacting each other and being heated, the air may be sufficiently heated by the heat of the flame.

In addition, by a flame generated from the inner periphery of the burner 110, since an air flows toward the fan 210 after being heated in the combustion chamber C, even if a flame is bent toward the fan 210 by the air flow due to the rotation of the fan 210, the flame may heat the air.

Hereinafter, an operation of the burner assembly will be described.

When an operation of the burner assembly 23 starts, a gas is sprayed from the nozzle holder 220 into the supply part 120 of the burner 110. Then, air A1 (air outside the frame) around the supply part 120 together with the gas may be supplied into the supply part 120. Here, the air A1 around the supply part 120 may be naturally supplied into the supply part 120 by a pressure difference because a low pressure is formed around the gas supplied into the supply part 120 (natural air-supply method). Thus, when the air is supplied into the supply part 120 by using the natural air-supply method, air that is required for burning a gas may not be sufficiently supplied into the supply part 120. In this case, the mixture gas in which the gas and air are mixed may be incompletely burned, and thus an amount of generated carbon dioxide may increase by the incomplete combustion.

However, according to the current embodiment, the insertion parts 151 and 167 of the burner cover 130 may pass through the bottom wall 32 of the frame 21 and be disposed outside the frame 21. Also, since the plurality of inflow holes 143, 167*a*, and 167*b* are defined outside the frame 21, additional air for burning the mixture gas of the burner 110 may be introduced into the combustion chamber C.

The additional air A2 introduced into the combustion chamber C may flow into the burner 110. As described above, since the burner 110 is spaced apart from the first plate 141 of the first cover 140 and the second plate 161 of the second cover 160, the air within the combustion chamber C may flow into the space between the burner 110 and the first plate 141 and the space between the burner 110 and the second plate 161.

Thus, the air within the combustion chamber C may smoothly flow to the gas outlet holes 114 which are defined on the burner 110.

Also, since the air guide 146 is disposed on the first cover 140, the additional air A2 may be guided to the gas outlet holes 114 by the air guide 146. Thus, the additional gas A2 may be sufficiently supplied to the gas outlet holes 114.

In the state where the mixture gas is supplied into the burner 110, the mixture gas may be ignited by the ignition unit 230 to generate flame in the burner 110. Also, the fan motor 212 may be turned on to rotate the fan 210.

When the fan 210 rotates, the air within the cooking chamber 22 may be introduced into the combustion chamber C through the air suction hole 192 of the assembly cover 190. Here, the air introduced into the combustion chamber C may pass through the region in which the inner periphery 112 of the burner 110 is defined.

The air introduced into the combustion chamber C may be heated by the flame generated in the burner 110, and then be discharged from the combustion chamber C.

The air discharged from the combustion chamber C may flow into the exhaust passage P1 defined between the second cover 160 and the rear wall 35 of the frame 21 and then be disposed into the cooking chamber 22 through the air discharge hole 194 of the assembly cover 190.

According to the current embodiment, the burner cover 130 may define the independent combustion chamber C, and the combustion chamber C and the exhaust passage P1 may be partitioned by the burner cover 130.

Thus, it may prevent the air flowing into the exhaust passage P1 from being reintroduced into the combustion chamber C.

Figure 22:
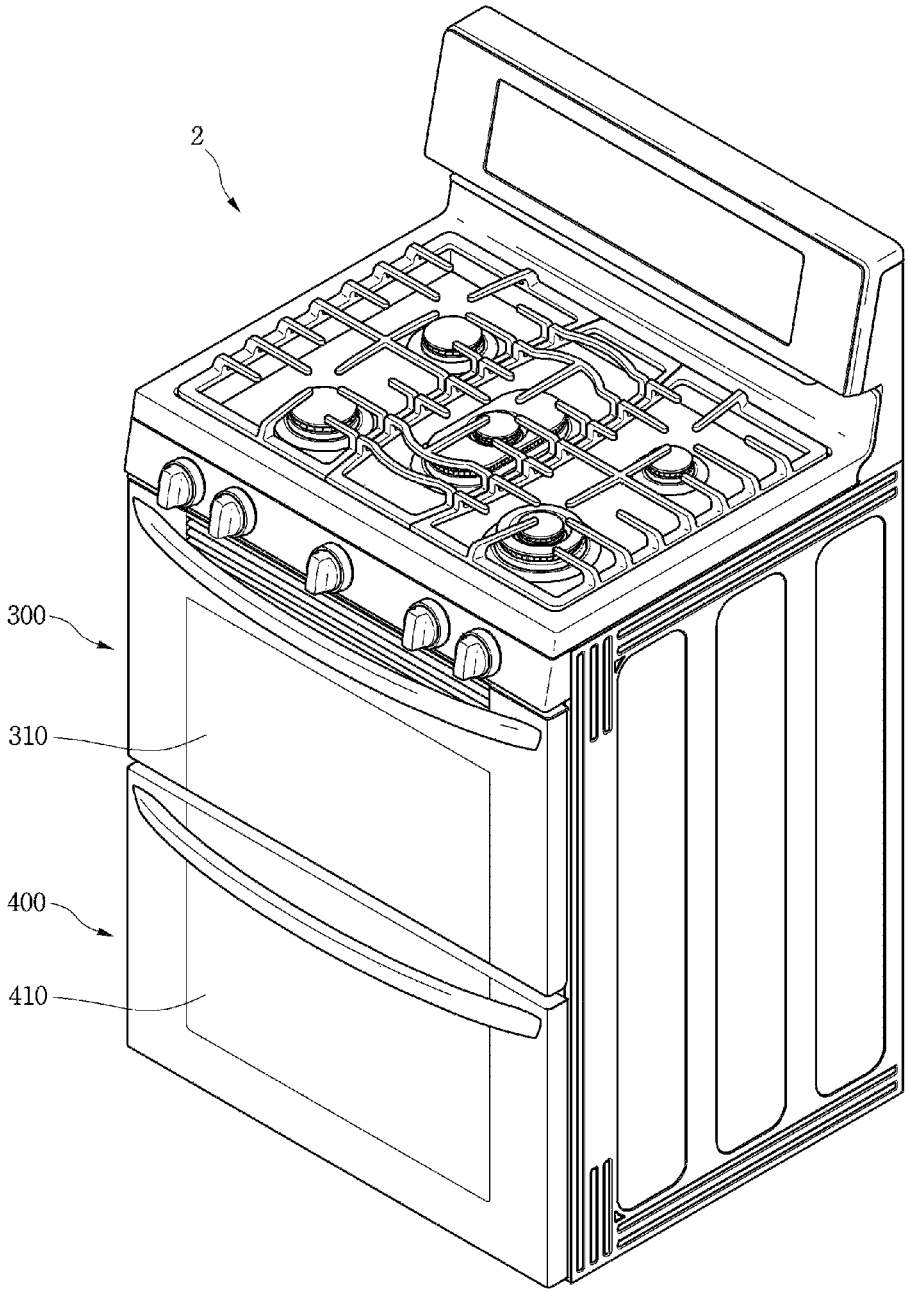
FIG. 22 is a perspective view of a cooking device according to another embodiment of the present invention.
Figure 23:
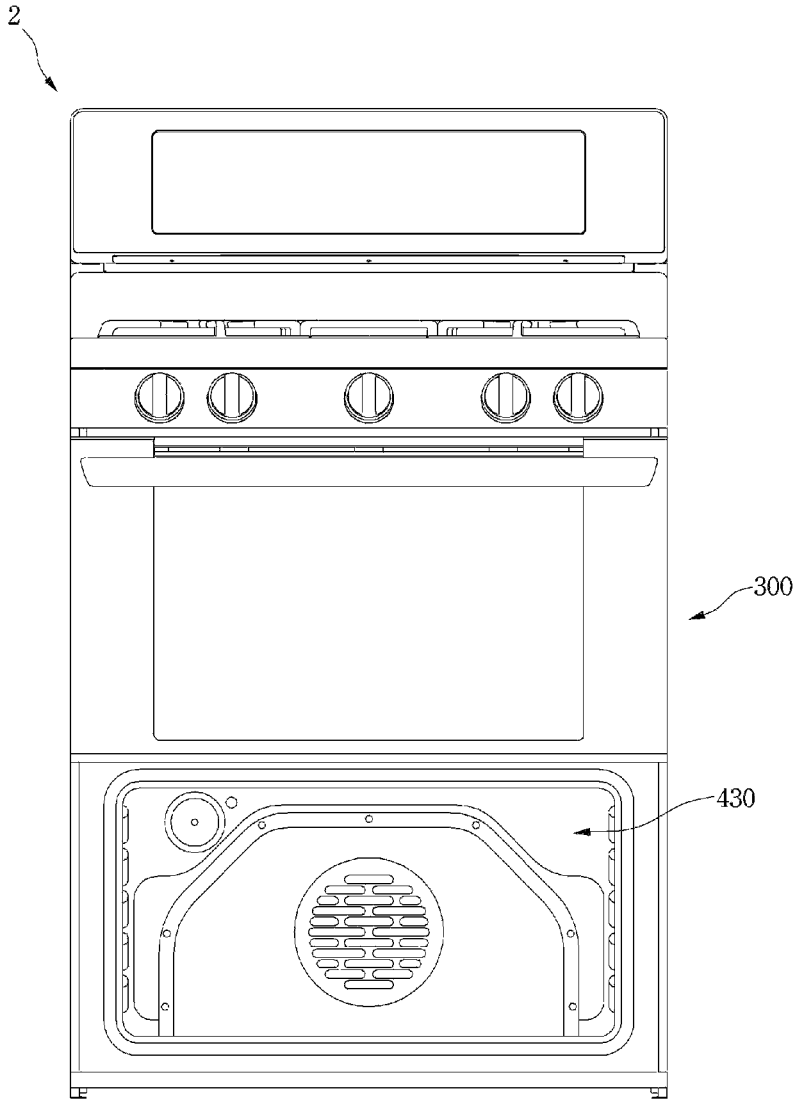
FIG. 23 is a front view of a cooking device of a state in which a second door is separated from FIG. 22.

FIG. 22 is a perspective view of a cooking appliance according to another embodiment of the present invention, and FIG. 23 is a front view of the cooking appliance in which a second door is removed in FIG. 22.

The current embodiment is the same as the previous embodiment except for the number of oven unit. Thus, a characterizing part according to the current embodiment will be principally described.

Referring to FIGS. 22 and 23, a cooking appliance 2 according to a second embodiment may include a plurality of oven units 300 and 400.

The plurality of oven units 300 and 400 may include a first oven unit 300 and a second oven unit 400 disposed under the first oven unit 300. The plurality of oven units 300 and 400 may include doors 310 and 410, respectively.

A burner assembly 430 may be disposed on at least one of the plurality of oven units 300 and 400. Since the burner assembly 430 has the same structure as that of the foregoing embodiment, its detailed description will be omitted.

Although the burner assembly 430 is disposed on the second oven unit 400 in FIG. 23, the burner assembly 430 may be disposed on the first oven unit 300 or each of the plurality of oven units 300 and 400.

In the above embodiment, although a burner cover has been described to include a first cover and a second cover, unlike this, the first cover may be omitted and the assembly cover may form a combustion chamber together with the second cover.

What is claimed is:

1. A cooking device comprising:

a frame that forms a cooking chamber;

a burner cover disposed in the cooking chamber, the burner cover defining a combustion chamber;

a burner disposed in the combustion chamber;

a fan that moves the air inside the cooking chamber; and a stabilizer installed on the burner cover, the stabilizer reducing an influence of the air on a flame of the burner, wherein the stabilizer comprises a forming unit that is formed in a direction away from the fan to increase a gap between the stabilizer and the fan.

2. The cooking device of claim 1, wherein the forming unit comprises an opening through which the air passes.

3. The cooking device of claim 2, wherein a diameter of the opening of the forming unit is less than an outer diameter of the fan.

4. The cooking device of claim 2, wherein the burner cover comprises:

a first cover covering a front of the burner; and a second cover covering a rear of the burner, wherein the stabilizer is installed on the second cover.

5. The cooking device of claim 4, wherein the forming unit is formed in a direction towards the first cover.

6. The cooking device of claim 4, wherein a diameter of the opening of the forming unit is less than a diameter of a second opening of the second cover.

7. The cooking device of claim 4, wherein the fan is disposed between the second cover and the frame.

8. The cooking device of claim 7, wherein the forming unit covers a portion of a front surface of the fan.

9. The cooking device of claim 4, wherein the stabilizer further comprises:

a stabilizer body having the opening; and a stabilizer barrier that extends from the stabilizer body.

10. The cooking device of claim 9, wherein the forming unit is located within an area formed by the stabilizer barrier.

11. The cooking device of claim 9, wherein the stabilizer barrier is extended vertically toward the first cover from the stabilizer body.

12. The cooking device of claim 9, wherein the stabilizer further comprises a stabilizer fastener that attaches the stabilizer body to the second cover.

13. The cooking device of claim 9, wherein the burner further comprises a gas outlet hole, and the stabilizer barrier extends toward the gas outlet hole from the stabilizer body.

14. The cooking device of claim 1, further comprising:

an assembly cover covering the burner cover, the assembly cover defining an exhaust passage between the assembly cover and a rear wall of the frame.

15. The cooking device of claim 14, wherein the fan is disposed in the exhaust passage.

* * * * *